United States Patent [19]

Stroem et al.

[11] Patent Number: 4,549,847

[45] Date of Patent: Oct. 29, 1985

[54] HIGH AREA RATIO, VARIABLE ENTRANCE GEOMETRY COMPRESSOR DIFFUSER

[75] Inventors: Sigmunn Stroem, Kongsberg; Rolf J. Mowill, Oslo, both of Norway

[73] Assignee: A.S. Kongsberg Vapenfabrikk, Kongsberg, Norway

[21] Appl. No.: 438,990

[22] Filed: Nov. 3, 1982

[51] Int. Cl.[4] ..... F02C 3/10

[52] U.S. Cl. ..... 415/182; 60/751; 415/157

[58] Field of Search ..... 415/181, 182, DIG. 1, 415/207, 157; 60/39.23, 39.29, 751

[56] References Cited

U.S. PATENT DOCUMENTS

| | | | |
|---|---|---|---|
| 2,557,435 | 6/1951 | Imbert | 239/265.25 |
| 3,123,285 | 3/1964 | Lee | 137/15.1 |
| 4,098,073 | 7/1978 | Adkins et al. | 60/751 X |
| 4,272,955 | 6/1981 | Hoffman et al. | 60/751 X |

FOREIGN PATENT DOCUMENTS

| | | | |
|---|---|---|---|
| 77080 | 8/1918 | Austria . | |
| 1227290 | 10/1966 | Fed. Rep. of Germany . | |
| 1628227 | 2/1971 | Fed. Rep. of Germany . | |
| 2721065 | 11/1978 | Fed. Rep. of Germany | 60/751 |
| 998465 | 1/1952 | France . | |
| 1121527 | 8/1956 | France . | |
| 1148637 | 12/1957 | France . | |

OTHER PUBLICATIONS

T. Rakoczy, "Anwendung von Prallplatten als Kurzdiffusoren bei lufttechnisehen Anlagen", VDI-Zeitschrift, vol. 112, No. 5, Mar. 1970, pp. 283-288.

*Primary Examiner*—Robert E. Garrett
*Assistant Examiner*—Joseph M. Pitko
*Attorney, Agent, or Firm*—Finnegan, Henderson, Farabow, Garrett & Dunner

[57] ABSTRACT

A composite diffuser for a radial compressor has a straight pipe transition portion positioned between a conically diverging upstream portion and a downstream flat plate diffuser portion to flatten the velocity profile prior to entrance into the plate diffuser portion.

7 Claims, 1 Drawing Figure

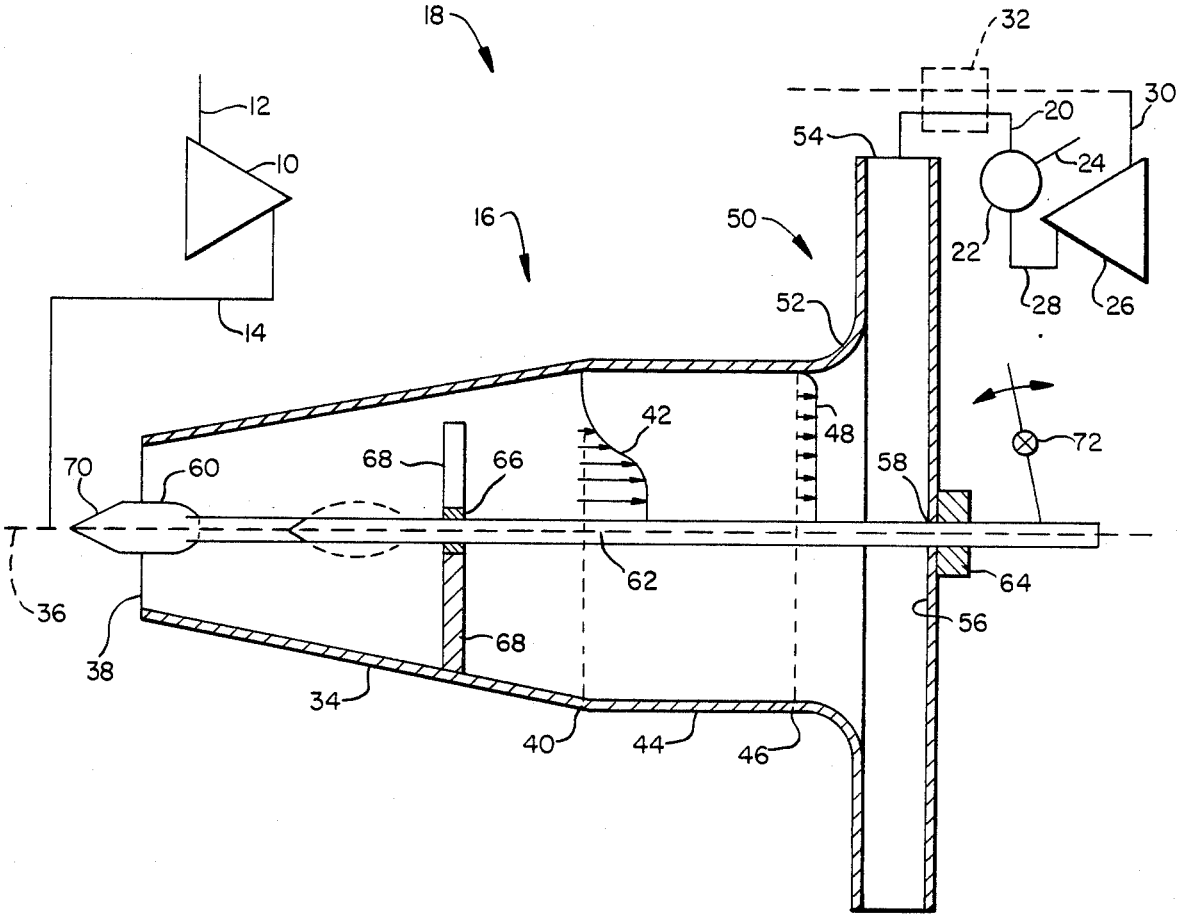
18
32
12
30
20
54
10
24
16
50
22
52
28
26
14
42
48
72
70
60
68
66
58
62
64
36
56
68
38
34
40
44
46

HIGH AREA RATIO, VARIABLE ENTRANCE GEOMETRY COMPRESSOR DIFFUSER

BACKGROUND OF THE INVENTION

1. Field of the Invention

The present invention relates to a high area ratio, variable entrance geometry diffuser apparatus for use in converting high velocity gas, exciting a rotary compressor, to relatively low velocity, thereby converting kinetic energy to pressure energy, and a method for controlling mass flow rate through the compressor.

2. Description of the Prior Art

It is well known in the art of rotary compressors that most applications call for a reduction in the relatively high velocities of the gases exiting from such compressor apparatus for subsequent utilization, such as in power producing gas turbine engines. To achieve the conversion of the kinetic energy of the high velocity gases to a pressure increase in the gas, diffusers are currently employed downstream of the compressors to achieve the conversion via a subsonic diffusion process. Vane-type diffusers, diffusing scrolls and pipe or channel-type diffusers are the two principle types of apparatus conventionally utilized with rotary compressors to achieve the desired kinetic energy conversion.

Pipe-type compressor diffusers have an advantage over vane-type diffusers in that they can provide a better structural member for the compressor and related components in certain applications, such as gas turbine engines. Furthermore, as a result of the discrete spacing of such pipe-type diffusers about the axis of a rotary compressor, such diffusers allow for inter-channel spacings where various conduits for gas and oil can be passed for use elsewhere in the system. None of the above-mentioned diffusers can diffuse efficiently to an area ratio above about 4:1–5:1.

In connection with recuperated gas turbine engines it is especially important to have a highly efficient diffuser in order to achieve maximum pressure recovery of the high velocity gases emmanating from the compressor. In centrifugal compressors with a high pressure ratio the kinetic energy at the exit of a typical 4:1 area ratio diffuser represents 2–3 percentage points in isentropic efficiency and a further diffusion is desirable.

SUMMARY OF THE INVENTION

The present invention relates to an apparatus and method where a pipe-type diffuser is utilized but where further diffusion recovers a significant part of the otherwise lost kinetic energy. The present invention also provides an apparatus and method for controllably varying the overall gas turbine engine mass flow rate, another feature important to the maintenance of high thermal efficiency at part load in recuperated gas turbine engines.

In accordance with the present invention, as embodied and broadly described herein, the diffuser apparatus of this invention for use in conjunction with a rotary compressor comprises a first stage having a smoothly increasing cross-sectional flow area in the flow direction, the first diffuser stage having an entrance for receiving gas at a relatively high velocity from the compressor and also having an exit; a plate-type radial diffuser stage positioned downstream of the first stage along the gas flow path through the diffuser, the radial stage having an axial inlet and radial outlet; and transition means operatively connecting the first diffuser stage to the plate diffuser stage for channeling gas flowing from the first stage exit to the plate stage inlet, reducing spatial variations in the gas velocity profile exiting the conical stage, and recovering kinetic energy from the reduced velocity variations.

Preferably, the connecting means includes a pipe member having essentially constant cross-sectional area and a length of from about 2.5 to 4.5 effective hydraulic diameters, wherein the pipe member also aligns the axis of the first stage to be co-linear with the inlet of the plate diffuser stage.

The accompanying drawing which is incorporated in, and constitutes a part of, the specification, illustrates one embodiment of the invention, and, together with the description, serves to explain the principles of the invention.

BRIEF DESCRIPTION OF THE DRAWING

FIG. 1 is a schematic view of the improved diffuser apparatus of the present invention shown in use in a gas turbine engine application.

Reference will now be made in detail to the present preferred embodiment of the invention, an example of which is illustrated in the accompanying drawing.

DESCRIPTION OF THE PREFERRED EMBODIMENT

There is shown in FIG. 1 a schematic representation of gas turbine engine apparatus 18 as or illustrative example of the utilization of the diffuser apparatus of the present invention, to be described in greater detail hereinafter. Gas turbine engine apparatus 18 includes a rotary compressor 10 having an inlet ducting 12 and having an outlet operatively connected to the pipe or channel diffuser apparatus of the present invention, designated 16 in FIG. 1. Compressor 10 can be axial or radial or mixed axial-radial and the present example is not intended to limit the type of rotary compressor with which the present invention can be used. Also, although diffuser 16 is shown schematically separate frm compressor 10 for easy understanding, one of ordinary skill in the art would understand that diffuser 16 can be made part of the compressor 10 housing, and this may be preferred because the diffuser 16 can be integrated into the framework of the compressor housing and add strength and rigidity to the overall structure.

Generally, the function of diffuser 16 is to convert the kinetic energy of the high velocity gas exiting the compressor 10 to a relatively higher static pressure, low velocity gas to be utilized, for instance by the other components of the gas turbine engine apparatus 18 to be discussed henceforth. As schematically depicted in FIG. 1, the high pressure, low velocity gas flows from diffuser 16 via ducting 20 to a combustion chamber 22 where it is mixed with fuel from a fuel source 24 and combusted. The hot combustion gases are then fed to turbine 26 via ducting 28 and expanded to produce mechanical work, as is well known. For applications calling for increased efficiency, such as industrial power production, heat values can be recovered from the turbine exhaust 30 and transferred to the compressed gas in ducting 20 such as by regenerator 32 (shown in broken lines in FIG. 1). The high efficiency advantages of such recuperated gas turbine engines are also understood by those skilled in the art.

In accordance with the present invention, diffuser 16 includes a first stage having a smoothly increasing cross-sectional flow area operatively connected to compressor 10 by ducting 14 to receive the high velocity gas from compressor 10. As embodied herein, diffuser 16 has a conical housing 34 which is symmetric about axis 36 and has a circular entrance 38 adapted to receive gas from compressor 10 via ducting 14. Other, non-circular cross sections such as rectangular, elliptical, etc. shapes may, of course, be used in place of the conical shape and are considered within the scope of the present invention. Generally, ducting 14 will be configured such that entrance 38 is proximate the vane tipe (not shown) of compressor 10 such that diffuser 16 is closely coupled aerodynamically to compressor 10.

It is important for the diffusing function that the cross-sectional flow area in the conical stage continually increases in the direction of flow, and the present invention contemplates conical housing 34 continuously increasing in cross-sectional area from the entrance 38 to the end 40 of the conical section. Preferably, the diameter at the end 40 is about 2 to 4 times the diameter of entrance 38. Those skilled in the art would realize that the rate of change in the flow area in conical housing 34 must be kept below certain values to avoid boundary layer separation on the inside walls of housing 34 due to the adverse pressure gradient. Such separation if allowed to occur, can seriously degrade overall diffuser performance.

Further in accordance with the present invention there is provided a transition diffuser stage at the outlet of the first stage for removing spatial variations in the gas velocity profile introduced in the conical section. It is known to those skilled in the art that flow through a concial diffuser results in a velocity profile highly skewed toward the center, with low velocities toward the conical wall. This is depicted schematically by the profile 42 in FIG. 1. Under certain, unwanted circumstances, the velocities near the conical wall can approach zero and become negative, indicating incipient reverse flow in the boundary layer next to the wall, possibly leading to boundary layer lift-off and separation. In order to control the boundary layer and to most effectively utilize the final plate-type diffuser stage 50 (to be discussed hereinafter), the transition stage should make the velocity profile nearly uniform across the flow cross section.

As embodied herein the transition diffuser stage includes a straight pipe portion 44 having essentially constant cross-sectional flow area between the conical stage outlet 40 and the end 46 of the transition stage. Pipe member 44 is aligned with its axis of symmetry co-linear with the conical stage axis 36. Pipe member 44 should be of sufficient length to allow mixing of the high velocity core (center flow) and the low velocity wall flows such that a relatively flat profile emerges at the transition stage end 46 (depicted schematically by profile 48). Preferably, a pipe member 44 length of about 2.5 to 4.5 times the pipe 44 diameter should be used, and the diameter of pipe 44 should be equal to the diameter of end 40 of the conical stage to provide a smooth transition from the conical stage to the transition stage.

It is important to realize that some pressure recovery can be achieved in the transition diffuser stage solely as a result of the change in the gas velocity profile, that is, without a change in the cross-sectional flow area in the transition stage. It is believed that used in conjunction with the remainder of diffuser 16, in accordance with the present invention, the transition diffuser stage will result in recovery of 50–60% of the theoretically recoverable kinetic energy remaining after the conical diffuser stage. For a typical 4:1 area ratio expansion in the conical stage the available kinetic energy represents 2–3 compressor efficiency percentage points.

Further in accordance with the present invention, a plate-type diffuser stage is provided to further diffuse the gas leaving the transition diffuser stage. As embodied herein, the plate diffuser stage includes an annular flange 50, an axial inlet 52 and, together with impact wall 56, forms an annular radial exit 54. Wall 56 serves to turn the impinging gas flow from a predominantly axial flow direction at the transition stage outlet 46 to a predominantly radial flow through the plate diffuser stage exit 54. In the embodiment shown in FIG. 1, gas flow leaving the plate diffuser stage exit 54 is collected and channelled to the combustion chamber 22 by ducting 20, as was explained previously.

Preferably, the ratio of the cross-sectional flow area at the plate diffuser stage exit 54 to the flow area at the plate diffuser inlet will range from about 2.5:1 to 3.5:1, and an overall exit/entrance area ratio for the diffuser 16 (that is, plate diffuser stage exit 54 area/conical diffuser stage entrance 38 area) from about 8.5:1 to 15:1 should be achievable, depending upon available space and the stability of compressor 10.

Further in accordance with the present invention, means are provided for adjustably varying the overall exit/entrance area ratio of the diffuser to provide control for the gas mass flow rate through the compressor and through the remainder of the gas turbine engine. It is well understood by one skilled in the art that at normal operation, the diffuser is the mass flow controlling element for high pressure ratio rotary compressors using closely coupled diffusers. In such diffusers, the entrance (throat) region is normally choked and therefore a variation in throat area will provide an equal variation in mass flow, as is well understood from gas dynamics considerations. For non-choked diffuser flow, the variation in mass flow also is dependent upon the absolute throat velocity, but the effect of the area variation is dominating, as one skilled in the art would understand and appreciate.

As embodied herein, the apparatus and method for compressor mass flow control utilizes means for smoothly varying the cross-sectional area available for gas flow in the conical diffuser stage 34, while maintaining the cross-sectional flow area in the transition diffuser stage 44 and the plate diffuser stage 5, including exit 5, essentially constant. As shown in FIG. 1, the area ratio varying means includes a spike member 60 positioned for movement along axis 36 in the portion of conical stage 34 near the entrance 38. Spike member 60 is connected to rod member 62 which extends the length of diffuser 16 and penetrates the plate diffuser stage wall 56 through aperture 58. A suitable sealing and bearing assembly 64 is provided at aperture 58 to allow reciprocal axial movement of rod 62 without leakage of the compressed gas, at least in part, and thus wall 56 acts to support rod 62 and spike 60. Additional bearing support for rod 62 may be provided, such as collar 66 and spacer strut 68 shown in FIG. 1 (only two of three evenly spaced struts shown), Spike 60 includes an aerodynamically contoured face portion 70 for presentation to the high velocity gases received from compressor 10. Also, the rear portion (unnumbered) of spike 60 should be smoothly tapered where it is fixedly connected to rod 62 to preclude abrupt expansion and consequent flow separation losses in that area.

Also included in the area ratio varying means depicted in the embodiment of FIG. 1 are means for adjusting the axial position of spike 6, including pivoting assembly 72 shown operatively connected to rod 62 outside plate diffuser stage wall 56. Although a lever mechanism is shown, it is clear that other actuating mechanisms of the mechanical, hydraulic, pneumatic and electrical types can be utilized to adjustably position rod 62 and spike 60.

From FIG. 1 it can be appreciated that as the position of spike 60 is moved from the dotted position totally within the conical stage 34 toward the conical stage entrance 38 (leftward in FIG. 1), the cross-sectional area available for flow through the entrance 38 of a conical stage 34 decreases, resulting in a corresponding decrease in the mass flow rate as explained previously. Although the use of a center body such as spike 60 and 62 in conical diffuser stage 34 adds additional friction losses because of the decreased effective hydraulic diameter $D_H$ of the flow cross section, a countervailing benefit is the reduction in the overall length of diffuser 16, which, for a given exit/entrance area ratio, varies inversely with $D_H$.

It would be apparent to those skilled in the art that various modifications and variations could be made in the diffuser apparatus of the present invention without departing from the scope or spirit of the invention.

What is claimed is:

1. Diffuser apparatus for use in conjunction with a rotary compressor, the apparatus comprising:

(a) a first stage having a smoothly increasing cross-sectional flow area in the direction of flow, said first stage having an entrance for receiving gas at a relatively high velocity from the compressor and also having an exit, (b) a plate-type radial diffuser stage positioned downstream of said first stage along the gas flow path through the diffuser, said radial stage having an axial inlet and radial outlet, said radial stage also having an impact surface mounted substantially orthogonal to the fluid flow direction in said axial inlet for turning the fluid flow into said radial outlet, and (c) transition means operatively connecting said first diffuser stage to said plate diffuser stage for channeling gas flowing from said first stage exit to said plate stage inlet, reducing spatial variations in the gas velocity profile exiting said first stage, and recovering kinetic energy as a consequence of said reduced volocity profile spatial variations.

2. Apparatus as in claim 1 wherein said plate diffuser stage has an exit/inlet area ratio of from about 2.51 to 3.5:1.

3. Diffuser apparatus for use in conjunction wth a rotary compressor, the apparatus comprising:

(a) a first stage having a smoothly increasing cross-sectional flow area in the direction of flow, said first stage having an entrance for receiving gas at a relatively high velocity from the compressor and also having an exit, (b) a plate-type radial diffuser stage positioned downstream of said first stage along the gas flow path through the diffuser, said radial stage having an axial inlet and radial outlet, and (c) transition means operatively connecting said first diffuser stage to said plate diffuser stage for channeling gas flowing from said first stage exit to said plate stage inlet, reducing spatial variations in the gas velocity profile exiting said first stage, and recovering kinetic energy as a consequence of said reduced velocity profile spatial variations wherein said transition means includes a pipe member having essentially constant cross-sectional area.

4. Diffuser apparatus as in claim 3 wherein said pipe member also aligns the axis of said first stage to be co-linear with the inlet of said plate diffuser stage.

5. Diffuser apparatus as in claim 3 wherein the length of said pipe member is from about 2.5 to 4.5 effective hydraulic diameters.

6. Apparatus as in claim 1 wherein the diameter of said first stage exit is about 2 to 4 times the diameter of said first stage entrance.

7. Improved apparatus for diffusing high velocity gas exiting a rotary compressor to increase static pressure, the diffuser apparatus being of the pipe or channel-type and having a pipe diffuser portion with a smoothly increasing cross-sectional flow area in the flow direction, the pipe diffuser portion including an entrance for receiving the gas from the compressor and an outlet, the inprovement comprising:

(a) a plate-type diffuser portion positioned downstream of the pipe diffuser portion for further diffusing the gas diffused in the pipe diffuser portion, the plate diffuser portion having an axial inlet and a radial exit; and (b) transition means operatively connecting the pipe diffuser portion to said plate diffuser portion; and wherein said transition means comprises additional diffuser means for reducing any spatial variation in the velocity profile of the air exiting the pipe diffuser portion before entering said plate diffuser portion, said additional diffuser means recovering at least part of the kinetic energy available from the spatially varying velocity profile, and wherein said additional diffuser means includes a pipe member having essentially constant cross-sectional flow area, the flow area of said pipe member, said plate diffuser inlet, and the pipe diffuser portion outlet being essentially equal, and the axes of said pipe member, said plate diffuser inlet, and the conical diffuser portion being essentially co-linear.

* * * * *